US009240296B2

(12) United States Patent
Krumpelman et al.

(10) Patent No.: US 9,240,296 B2
(45) Date of Patent: Jan. 19, 2016

(54) KEYBOARD CONSTRUCTION HAVING A SENSING LAYER BELOW A CHASSIS LAYER

(71) Applicant: SYNAPTICS INCORPORATED, San Jose, CA (US)

(72) Inventors: Douglas M. Krumpelman, Hayden, ID (US); Peter Bokma, Coeur d'Alene, ID (US); Cody G. Peterson, Hayden, ID (US); Andrew P. Huska, Liberty Lake, WA (US)

(73) Assignee: Synaptics Incorporated, San Jose, CA (US)

( * ) Notice: Subject to any disclaimer, the term of this patent is extended or adjusted under 35 U.S.C. 154(b) by 135 days.

(21) Appl. No.: 13/960,316

(22) Filed: Aug. 6, 2013

(65) Prior Publication Data

US 2014/0034472 A1 Feb. 6, 2014

Related U.S. Application Data

(60) Provisional application No. 61/680,010, filed on Aug. 6, 2012, provisional application No. 61/816,654, filed on Apr. 26, 2013.

(51) Int. Cl.
*H01H 9/26* (2006.01)
*H01H 13/72* (2006.01)
(Continued)

(52) U.S. Cl.
CPC ..... *H01H 13/70* (2013.01); *H01H 13/7065* (2013.01); *H01H 13/85* (2013.01); *H01H 13/704* (2013.01); *H01H 2203/028* (2013.01); *H01H 2221/04* (2013.01); *H01H 2221/058* (2013.01)

(58) Field of Classification Search
CPC ..... H01H 9/26; H01H 13/72; H01H 13/76; H01H 9/00; H01H 3/48; H01H 13/70; H01H 1/06; H01H 3/12; H01H 1/60; H01H 2227/032; H01H 2227/034; H01H 13/84; H01H 13/85; H01H 35/00; H01H 35/2614; H01H 35/2621; H01H 35/2628; H01H 35/2685; H01H 2211/032
See application file for complete search history.

(56) References Cited

U.S. PATENT DOCUMENTS 4,168,464 A 9/1979 Coulson et al.
4,459,541 A 7/1984 Fielden et al.
(Continued)

FOREIGN PATENT DOCUMENTS

CN 102035525 A 4/2011
CN 102541275 A 7/2012
(Continued)

OTHER PUBLICATIONS

Top view image of a Dell XPS 15Z keyboard (2011).
(Continued)

*Primary Examiner* — Edwin A. Leon
*Assistant Examiner* — Anthony R. Jimenez
(74) *Attorney, Agent, or Firm* — Osha Liang LLP

(57) ABSTRACT

A keyboard having a sensor layer below a chassis layer is described. In one embodiment, the keyboard includes a keyboard chassis and a plurality of keycaps positioned above the keyboard chassis. Each of the plurality of keycaps has a touch surface for receiving a press force. A sensor substrate is positioned below the keyboard chassis and has sensor electrodes configured to sense that one or more of the plurality of keycaps is in a pressed position.

20 Claims, 9 Drawing Sheets

(51) Int. Cl.

| | |
|---|---|
| ***H01H 13/76*** | (2006.01) |
| ***H01H 13/70*** | (2006.01) |
| ***H01H 13/7065*** | (2006.01) |
| ***H01H 13/85*** | (2006.01) |
| *H01H 13/704* | (2006.01) |

(56) References Cited

U.S. PATENT DOCUMENTS

| | | | | |
|---|---|---|---|---|
| 4,918,454 | A | 4/1990 | Early et al. | |
| 5,038,142 | A | 8/1991 | Flowers et al. | |
| 5,767,463 | A | 6/1998 | Gandre | |
| 5,801,340 | A | 9/1998 | Peter | |
| 6,014,022 | A | 1/2000 | Demma et al. | |
| 6,204,839 | B1 | 3/2001 | Mato, Jr. | |
| 6,217,183 | B1 | 4/2001 | Shipman | |
| 6,225,710 | B1 | 5/2001 | Palata et al. | |
| 6,466,036 | B1 | 10/2002 | Philipp | |
| 6,467,924 | B2 | 10/2002 | Shipman | |
| 6,497,521 | B1 * | 12/2002 | Lohr | 400/491 |
| 6,703,845 | B2 | 3/2004 | Stanley et al. | |
| 6,724,324 | B1 | 4/2004 | Lambert | |
| 6,839,247 | B1 | 1/2005 | Yang et al. | |
| 6,918,677 | B2 | 7/2005 | Shipman | |
| 7,151,528 | B2 | 12/2006 | Taylor et al. | |
| 7,172,303 | B2 | 2/2007 | Shipman et al. | |
| 7,193,535 | B2 | 3/2007 | Shipman | |
| 7,193,536 | B2 | 3/2007 | Shipman | |
| 7,283,066 | B2 | 10/2007 | Shipman | |
| 7,382,360 | B2 | 6/2008 | Mackey et al. | |
| 7,444,163 | B2 | 10/2008 | Ban et al. | |
| 7,808,487 | B2 | 10/2010 | Taylor et al. | |
| 8,068,097 | B2 | 11/2011 | GuangHai | |
| 8,124,903 | B2 | 2/2012 | Tatehata et al. | |
| 8,207,872 | B2 | 6/2012 | Huang et al. | |
| 8,255,002 | B2 | 8/2012 | Nakahara et al. | |
| 8,274,478 | B2 | 9/2012 | Bowen | |
| 8,305,359 | B2 | 11/2012 | Bolender et al. | |
| 8,309,870 | B2 | 11/2012 | Peterson et al. | |
| 8,310,351 | B2 | 11/2012 | Krahenbuhl et al. | |
| 8,339,288 | B2 | 12/2012 | Lee et al. | |
| 8,414,207 | B1 | 4/2013 | Knighton et al. | |
| 8,446,264 | B2 | 5/2013 | Tanase | |
| 8,451,228 | B2 | 5/2013 | Chuang et al. | |
| 8,648,737 | B1 | 2/2014 | Bowen | |
| 8,674,941 | B2 | 3/2014 | Casparian et al. | |
| 2001/0040802 | A1 | 11/2001 | Shipman | |
| 2001/0045733 | A1 | 11/2001 | Stanley et al. | |
| 2002/0015023 | A1 | 2/2002 | Watanabe et al. | |
| 2002/0030666 | A1 | 3/2002 | Philipp | |
| 2003/0091220 | A1 | 5/2003 | Sato et al. | |
| 2003/0184533 | A1 | 10/2003 | Roh et al. | |
| 2004/0113634 | A1 | 6/2004 | Stanley et al. | |
| 2005/0016273 | A1 | 1/2005 | Murata et al. | |
| 2005/0089356 | A1 | 4/2005 | Jung-Tsung | |
| 2005/0184799 | A1 | 8/2005 | Kii | |
| 2005/0218913 | A1 | 10/2005 | Inaba et al. | |
| 2006/0232559 | A1 | 10/2006 | Chien et al. | |
| 2007/0165002 | A1 | 7/2007 | Wassingbo | |
| 2007/0205990 | A1 | 9/2007 | Gloyd et al. | |
| 2007/0247431 | A1 | 10/2007 | Skillman et al. | |
| 2008/0042980 | A1 | 2/2008 | Bowen | |
| 2008/0062015 | A1 | 3/2008 | Bowen | |
| 2008/0143560 | A1 | 6/2008 | Shipman | |
| 2009/0115431 | A1 | 5/2009 | Philipp | |
| 2009/0115732 | A1 | 5/2009 | Tao et al. | |
| 2009/0201179 | A1 | 8/2009 | Shipman et al. | |
| 2010/0128427 | A1 * | 5/2010 | Iso | 361/679.09 |
| 2010/0253629 | A1 | 10/2010 | Orsley | |
| 2010/0259481 | A1 | 10/2010 | Oh | |
| 2010/0259482 | A1 | 10/2010 | Ball | |
| 2010/0309130 | A1 | 12/2010 | Zhao et al. | |
| 2010/0321301 | A1 | 12/2010 | Casparian et al. | |
| 2010/0328251 | A1 | 12/2010 | Sinclair | |
| 2011/0025607 | A1 | 2/2011 | Bowen | |
| 2011/0095919 | A1 | 4/2011 | Ostermoller et al. | |
| 2011/0205161 | A1 | 8/2011 | Myers et al. | |
| 2011/0227762 | A1 | 9/2011 | Bowen | |
| 2011/0227872 | A1 | 9/2011 | Huska et al. | |
| 2011/0241997 | A1 | 10/2011 | Yang | |
| 2012/0019445 | A1 | 1/2012 | Liu | |
| 2012/0050167 | A1 | 3/2012 | Krahenbuhl et al. | |
| 2012/0119996 | A1 | 5/2012 | Wu et al. | |
| 2012/0139843 | A1 | 6/2012 | Shipman et al. | |
| 2012/0169603 | A1 * | 7/2012 | Peterson et al. | 345/168 |
| 2012/0274567 | A1 | 11/2012 | Suggs | |
| 2012/0299832 | A1 | 11/2012 | Peterson et al. | |
| 2013/0021257 | A1 | 1/2013 | Pedersen et al. | |
| 2013/0082932 | A1 | 4/2013 | Gluckstad et al. | |
| 2013/0093681 | A1 | 4/2013 | Hsu | |
| 2013/0100030 | A1 | 4/2013 | Los et al. | |
| 2013/0135207 | A1 | 5/2013 | Neil et al. | |
| 2013/0135211 | A1 | 5/2013 | Chiang et al. | |
| 2013/0222260 | A1 | 8/2013 | Tanase | |
| 2013/0265062 | A1 | 10/2013 | Wang et al. | |
| 2013/0314325 | A1 | 11/2013 | Furukawa | |
| 2013/0342494 | A1 | 12/2013 | Feng | |
| 2014/0001021 | A1 | 1/2014 | Zhang | |
| 2014/0002358 | A1 | 1/2014 | Bruwer | |
| 2014/0022177 | A1 | 1/2014 | Shaw et al. | |
| 2014/0034468 | A1 | 2/2014 | Krumpelman et al. | |
| 2014/0055363 | A1 | 2/2014 | Meierling et al. | |

FOREIGN PATENT DOCUMENTS

| | | | |
|---|---|---|---|
| CN | 102832921 | A | 12/2012 |
| CN | 202694270 | U | 1/2013 |
| DE | 3933552 | | 4/1990 |
| DE | 102010012969 | A1 | 9/2011 |
| JP | 6507723 | A | 9/1994 |
| JP | 2011233406 | A * | 11/2011 |
| KR | 1020080005021 | A | 1/2008 |
| TW | M441152 | U | 11/2012 |
| WO | 0120628 | A1 | 3/2001 |
| WO | 2007024213 | A1 | 3/2007 |

OTHER PUBLICATIONS

Bottom view image of a Dell XPS 15Z keyboard (2011).

S.M. Huang et al., "Electronic transducers for industrial measurement of low value capacitances", J. Phys. E. Sci. Instrum. 21, pp. 242-250 (1988).

Ph D Thesis of Toth, Ferry N. "A Design Methodology for Low-Cost, High-Performance Capacitive sensors". Delft University of Technology, The Netherlands, Delft University Press, ISBN 90-407-X (1997).

Master of Science in Electrical Engineering Thesis of Hsieh, Ping-Hsuan, "CMOS LC Oscillators for Lower-Power MEMS Applications." University of California, Los Angeles, 2004.

Yamada, Mitsuhiro et al., "A Capacitive Pressure Sensor Interface using Oversampling Δ-Σ Demodulation Techniques," IEEE, vol. 46, No. 1, pp. 3-7, Feb. 1997.

Yang, W.Q., "A Self-Balancing Circuit to Measure Capacitance and Loss Conductance for Industrial Transducer Applications," IEEE, vol. 45, No. 6, pp. 955-958, Dec. 1996.

Boser, Bernhard E., "Capacitive Position Sense Circuits," Berkley Sensor & Actuator Center, pp. 1-57, 1996.

Burstein, Amit et al., "Mixed Analog-Digital Highly Sensitive Sensor Interface Circuit for Low-Cost Microsensors," Sensors and Actuators, A 52, pp. 193-197, 1996.

Kung, Joseph T. et al., "Digital Cancellation of Noise and Offset for Capacitive Sensors," IEEE, vol. 42, No. 5, pp. 939-942, Oct. 1993.

Kung, Joseph T. et al., "A Digital Readout Technique for Capacitive Sensor Applications," IEEE, vol. 23, No. 4, pp. 972-977, Aug. 1988.

Leuthold, H. et al., "An ASIC for High-Resolution Capacitive Microaccelerometers," Sensors and Actuators, A21-A23, pp. 278-281, 1990.

Lotters, Joost C. et al., "Sensitive Differential Capacitance to Voltage Converter for Sensor Applications," IEEE, vol. 48, No. 1, pp. 89-96, Feb. 1999.

Shimizu, Hiromi et al., "A Digital Hygrometer," IEEE, vol. 37, No. 2, pp. 300-304, Jun. 1988.

(56) References Cited

OTHER PUBLICATIONS

Cichocki et al. "A Switched Capacitor Interface for Capacitive Sensors Based on Relaxation Oscillators," IEEE Transactions on Instrumentation and Measurement, vol. 39, No. 5, pp. 797-799 (Oct. 1990).
Philipp, H., "Charge Transfer Sensing: Spread Spectrum Sensor Technology Blazes New Applications," http://www.qprox.com/background/white_paper.php. 1997, 9 pages.
Yamada M. et al., "A Switched Capacitor Interface for Capacitive Pressure Sensors," IEEE Transactions on Instrumentation and Measurement, vol. 31, No. 1, pp. 81-86 (Feb. 1992).
Baxter, Larry K., "Capacitive Sensors: Design and Applications," IEEE Press, ISBN 078035351X, Sections 4.2.1, 4.2.3, 4.2.4, 4.3.3, 4.5.1, 6.4.2, 10.3.5, and 11.4.2, 1997.
Kung, Joseph T., "Integrated Capacitive Sensors Using Charge-Redistribution Sense Techniques," MIT Department of Electrical Engineering and Computer Science, 2 pages, 1992.
Agilent Technologies, Inc., Agilent 33220A 20 MHz Function/Arbitrary Waveform Generator Data Sheet, USA, May 1, 2004.
Agilent Technologies, Inc., Agilent 33220A 20 MHz Function/Arbitrary Waveform Generator Data Sheet, USA, Apr. 19, 2006.

* cited by examiner

KEYBOARD CONSTRUCTION HAVING A SENSING LAYER BELOW A CHASSIS LAYER

RELATED APPLICATION(S)

This application claims the benefit of U.S. Provisional Application No. 61/680,010 filed Aug. 6, 2012. This application also claims the benefit of U.S. Provisional Application No. 61/816,654 filed Apr. 26, 2013.

FIELD OF THE INVENTION

This invention generally relates to electronic devices.

BACKGROUND OF THE INVENTION

Pressable touchsurfaces (touch surfaces which can be pressed) are widely used in a variety of input devices, including as the surfaces of keys or buttons for keypads or keyboards, and as the surfaces of touch pads or touch screens. It is desirable to improve the usability of these input systems.

FIG. 2 shows a graph 200 of an example tactile response curve associated with the "snapover" haptic response found in many keys enabled with metal snap domes or rubber domes. Specifically, graph 200 relates force applied to the user by a touchsurface of the key (a reaction force resisting a press of the key by the user) and the amount of key displacement (movement relative to its unpressed position). The force applied to the user may be a total force or the portion of the total force along a particular direction such as the positive or negative press direction. Similarly, the amount of key displacement may be a total amount of key travel or the portion along a particular direction such as the positive or negative press direction.

The force curve 210 shows four key press states 212, 214, 216, 218 symbolized with depictions of four rubber domes at varying amounts of key displacement. The key is in the "unpressed" state 212 when no press force is applied to the key and the key is in the unpressed position (i.e., "ready" position). In response to press input, the key initially responds with some key displacement and increasing reaction force applied to the user. The reaction force increases with the amount of key displacement until it reaches a local maximum "peak force" $F_1$ in the "peak" state 214. In the peak state 214, the metal snap dome is about to snap or the rubber dome is about to collapse. The key is in the "contact" state 216 when the keycap, snap dome or rubber dome, or other key component moved with the keycap makes initial physical contact with the base of the key (or a component attached to the base) with the local minimum "contact force" $F_2$. The key is in the "bottom" state 218 when the key has travelled past the "contact" state and is mechanically bottoming out, such as by compressing the rubber dome in keys enabled by rubber domes.

A snapover response is defined by the shape of the reaction force curve—affected by variables such as the rate of change, where it peaks and troughs, and the associated magnitudes. The difference between the peak force $F_1$ and the contact force $F_2$ can be termed the "snap." The "snap ratio" can be determined as $(F_1-F_2)/F_1$ (or as $100*(F_1-F_2)/F_1$, if a percent-type measure is desired).

BRIEF SUMMARY OF THE INVENTION

A keyboard assembly is described. In one embodiment, the keyboard includes a keyboard chassis and a plurality of keycaps positioned above the keyboard chassis. Each keycap of the plurality of keycaps has a touch surface for receiving a press force. A sensor substrate is positioned below the keyboard chassis and has sensor electrodes configured to sense that one or more keycaps of the plurality of keycaps is in a pressed position.

In another embodiment, a keyboard includes a chassis and a keycap positioned above the chassis having a touch surface for receiving a press force. A biasing mechanism is positioned between the keycap and the chassis. The biasing mechanism biases the keycap toward an unpressed position. A sensor substrate is positioned below the chassis and has sensor electrodes configured to sense that the keycap is in a pressed position.

In still another embodiment, a keyboard includes a keyboard chassis and a plurality of keycaps positioned above the keyboard chassis. Keycaps of the plurality of keycaps have touch surfaces for receiving press forces. Each key guide of a plurality of key guides are respectively associated with a keycap of the plurality of keycaps. A plurality of end stops is associated with the plurality of keycaps, with each end stop positioned between the keyboard chassis and a respective keycap. The keyboard also includes a plurality of biasing mechanisms associated with the plurality of keycaps, with each respective biasing mechanism biasing a respective keycap toward an unpressed position. Further, each of the plurality of keycaps has a first portion of a respective biasing mechanism and each of the key guides has a second portion of the respective biasing mechanism. Also, a sensor substrate is positioned below the keyboard chassis and includes sensor electrodes configured to sense that one or more of the plurality of keycaps is in a pressed position.

BRIEF DESCRIPTION OF DRAWINGS

Example embodiments of the present invention will hereinafter be described in conjunction with the appended drawings which are not to scale unless otherwise noted, where like designations denote like elements, and.

DETAILED DESCRIPTION OF THE INVENTION

The following detailed description is merely exemplary in nature and is not intended to limit the invention or the application and uses of the invention.

Various embodiments of the present invention provide input devices and methods that facilitate improved usability, thinner devices, easier assembly, lower cost, more flexible industrial design, or a combination thereof. These input devices and methods involve pressable touchsurfaces that may be incorporated in any number of devices. As some examples, pressable touchsurfaces may be implemented as surfaces of touchpads, touchscreens, keys, buttons, and the surfaces of any other appropriate input device. Thus, some non-limiting examples of devices that may incorporate pressable touchsurfaces include personal computers of all sizes and shapes, such as desktop computers, laptop computers, netbooks, ultrabooks, tablets, e-book readers, personal digital assistants (PDAs), and cellular phones including smart phones. Additional example devices include data input devices (including remote controls, integrated keyboards or keypads such as those within portable computers, or peripheral keyboards or keypads such as those found in tablet covers or stand-alone keyboards, control panels, and computer mice), and data output devices (including display screens and printers). Other examples include remote terminals, kiosks, point-of-sale devices, video game machines (e.g., video game consoles, portable gaming devices, and the like) and media devices (including recorders, editors, and players such as televisions, set-top boxes, music players, digital photo frames, and digital cameras).

The discussion herein focuses largely on rectangular touchsurfaces. However, the touchsurfaces for many embodiments can comprises other shapes. Example shapes include triangles, quadrilaterals, pentagons, polygons with other numbers of sides, shapes similar to polygons with rounded corners or nonlinear sides, shapes with curves, elongated or circular ellipses circles, combinations shapes with portions of any of the above shapes, non-planar shapes with concave or convex features, and any other appropriate shape.

In addition, although the discussion herein focuses largely on the touchsurfaces as being atop rigid bodies that undergo rigid body motion, some embodiments may comprise touchsurfaces atop pliant bodies that deform. "Rigid body motion" is used herein to indicate motion dominated by translation or rotation of the entire body, where the deformation of the body is negligible. Thus, the change in distance between any two given points of the touchsurface is much smaller than an associated amount of translation or rotation of the body.

Also, in various implementations, pressable touchsurfaces may comprise opaque portions that block light passage, translucent or transparent portions that allow light passage, or both.

Figure 1:
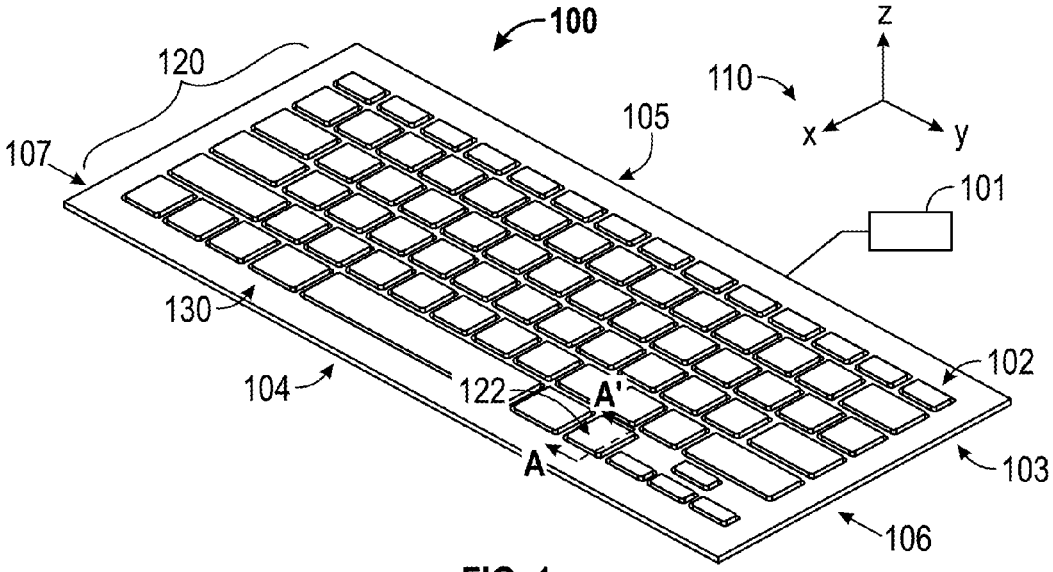
FIG. 1 shows an example keyboard that incorporates one or more implementations of key-based touchsurfaces configured in accordance with the techniques described herein.

FIG. 1 shows an example keyboard 100 that incorporates a plurality of (two or more) pressable key-based touchsurfaces configured in accordance with the techniques described herein. The example keyboard 100 comprises rows of keys 120 of varying sizes surrounded by a keyboard bezel 130. Keyboard 100 has a QWERTY layout, even though the keys 120 are not thus labeled in FIG. 1. Other keyboard embodiments may comprise different physical key shapes, key sizes, key locations or orientations, or different key layouts such as DVORAK layouts or layouts designed for use with special applications or non-English languages. In some embodiments, the keys 120 comprise keycaps that are rigid bodies, such as rigid rectangular bodies having greater width and breadth than depth (depth being in the Z direction as explained below). Also, other keyboard embodiments may comprise a single pressable key-based touchsurface configured in accordance with the techniques described herein, such that the other keys of these other keyboard embodiments are configured with other techniques.

Orientation terminology is introduced here in connection with FIG. 1, but is generally applicable to the other discussions herein and the other figures unless noted otherwise. This terminology introduction also includes directions associated with an arbitrary Cartesian coordinate system. The arrows 110 indicate the positive directions of the Cartesian coordinate system, but do not indicate an origin for the coordinate system. Definition of the origin will not be needed to appreciate the technology discussed herein.

The face of keyboard 100 including the exposed touchsurfaces configured to be pressed by users is referred to as the "top" 102 of the keyboard 100 herein. Using the Cartesian coordinate directions indicated by the arrows 110, the top 102 of the keyboard 100 is in the positive-Z direction relative to the bottom 103 of the keyboard 100. The part of the keyboard 100 that is typically closer to the body of a user when the keyboard 100 is in use atop a table top is referred to as the "front" 104 of the keyboard 100. In a QWERTY layout, the front 104 of the keyboard 100 is closer to the space bar and further from the alphanumeric keys. Using the Cartesian coordinate directions indicated by the arrows 110, the front 104 of the keyboard 100 is in the positive-X direction relative to the back 105 of the keyboard 100. In a typical use orientation where the top 102 of the keyboard 100 is facing upwards and the front 104 of the keyboard 100 is facing towards the user, the "right side" 106 of the keyboard 100 is to the right of a user. Using the Cartesian coordinate directions indicated by the arrows 110, the right side 106 of the keyboard 100 is in the positive-Y direction relative to the "left side" 107 of the keyboard 100. With the top 102, front 104, and right side 106 thus defined, the "bottom" 103, "back" 105, and "left side" 107 of the keyboard 100 are also defined.

Using this terminology, the press direction for the keyboard 100 is in the negative-Z direction, or vertically downwards toward the bottom of the keyboard 100. The X and Y directions are orthogonal to each other and to the press direction. Combinations of the X and Y directions can define an infinite number of additional lateral directions orthogonal to the press direction. Thus, example lateral directions include the X direction (positive and negative), the Y direction (positive and negative), and combination lateral directions with components in both the X and Y directions but not the Z direction. Motion components in any of these lateral directions is sometimes referred herein as "planar," since such lateral motion components can be considered to be in a plane orthogonal to the press direction.

Some or all of the keys of the keyboard 100 are configured to move between respective unpressed and pressed positions that are spaced in the press direction and in a lateral direction orthogonal to the press direction. That is, the touchsurfaces of these keys exhibit motion having components in the negative Z-direction and in a lateral direction. In the examples described herein, the lateral component is usually in the positive X-direction or in the negative X-direction for ease of understanding. However, in various embodiments, and with reorientation of select key elements as appropriate, the lateral separation between the unpressed and the pressed positions may be solely in the positive or negative X-direction, solely in the positive or negative Y-direction, or in a combination with components in both the X and Y directions.

Thus, these keys of the keyboard 100 can be described as exhibiting "diagonal" motion from the unpressed to the pressed position. This diagonal motion is a motion including both a "Z" (or vertical) translation component and a lateral (or planar) translation component. Since this planar translation occurs with the vertical travel of the touchsurface, it may be called "planar translational responsiveness to vertical travel" of the touchsurface, or "vertical-lateral travel."

Some embodiments of the keyboard 100 comprise keyboards with leveled keys that remain, when pressed during normal use, substantially level in orientation through their respective vertical-lateral travels. That is, the keycaps of these leveled keys (and thus the touchsurfaces of these keys) exhibit little or no rotation along any axes in response to presses that occur during normal use. Thus, there is little or no roll, pitch, and yaw of the keycap and the associated touchsurfaces remain relatively level and substantially in the same orientation during their motion from the unpressed position to the pressed position.

In various embodiments, the lateral motion associated with the vertical-lateral travel can improve the tactile feel of the key by increasing the total key travel for a given amount of vertical travel in the press direction. In various embodiments, the vertical-lateral travel also enhances tactile feel by imparting to users the perception that the touchsurface has travelled a larger vertical distance than actually travelled. For example, the lateral component of vertical-lateral travel may apply tangential friction forces to the skin of a finger pad in contact with the touchsurface, and cause deformation of the skin and finger pad that the user perceives as additional vertical travel. This then creates a tactile illusion of greater vertical travel. In some embodiments, returning the key from the pressed to the unpressed position on the return stroke also involves simulating greater vertical travel using lateral motion.

To enable the keys 120 of the keyboard 100 with vertical-lateral travel, the keys 120 are parts of key assemblies each comprising mechanisms for effecting planar translation, readying the key 120 by holding the associated keycap in the unpressed position, and returning the key 120 to the unpressed position. Some embodiments further comprise mechanisms for leveling keycaps. Some embodiments achieve these functions with a separate mechanism for each function, while some embodiments achieve two or more of these functions using a same mechanism. For example, a "biasing" mechanism may provide the readying function, the returning function, or both the readying and returning functions. Mechanisms which provide both readying and returning functions are referred to herein as "ready/return" mechanisms. As another example, a leveling/planar-translation-effecting mechanisms may level and effect planar translation. As further examples, other combinations of functions may be provided by a same mechanism.

The keyboard 100 may use any appropriate technology for detecting presses of the keys of the keyboard 100. For example, the keyboard 100 may employ a key switch matrix based on conventional resistive membrane switch technology. The key switch matrix may be located under the keys 120 and configured to generate a signal to indicate a key press when a key 120 is pressed. Alternatively, the example keyboard 100 may employ other key press detection technology to detect any changes associated with the fine or gross change in position or motion of a key 120. Example key press detection technologies include various capacitive, resistive, inductive, magnetic, force or pressure, linear or angular strain or displacement, temperature, aural, ultrasonic, optical, and other suitable techniques. With many of these technologies, one or more preset or variable thresholds may be defined for identifying presses and releases.

As a specific example, capacitive sensor electrodes may be disposed under the touchsurfaces, and detect changes in capacitance resulting from changes in press states of touchsurfaces. The capacitive sensor electrodes may utilize "self capacitance" (or "absolute capacitance") sensing methods based on changes in the capacitive coupling between the sensor electrodes and the touchsurface. In some embodiments, the touchsurface is conductive in part or in whole, or a conductive element is attached to the touchsurface, and held at a constant voltage such as system ground. A change in location of the touchsurface alters the electric field near the sensor electrodes below the touchsurface, thus changing the measured capacitive coupling. In one implementation, an absolute capacitance sensing method operates with a capacitive sensor electrode underlying a component having the touchsurface, modulates that sensor electrodes with respect to a reference voltage (e.g., system ground), and detects the capacitive coupling between that sensor electrode and the component having the touchsurface for gauging the press state of the touchsurface.

Some capacitive implementations utilize "mutual capacitance" (or "transcapacitance") sensing methods based on changes in the capacitive coupling between sensor electrodes. In various embodiments, the proximity of a touchsurface near the sensor electrodes alters the electric field between the sensor electrodes, thus changing the measured capacitive coupling. The touchsurface may be a conductive or non-conductive, electrically driven or floating, as long as its motion causes measurable change in the capacitive coupling between sensor electrodes. In some implementations, a transcapacitive sensing method operates by detecting the capacitive coupling between one or more transmitter sensor electrodes (also "transmitters") and one or more receiver sensor electrodes (also "receivers"). Transmitter sensor electrodes may be modulated relative to a reference voltage (e.g., system ground) to transmit transmitter signals. Receiver sensor electrodes may be held substantially constant relative to the reference voltage to facilitate receipt of resulting signals. A resulting signal may comprise effect(s) corresponding to one or more transmitter signals, and/or to one or more sources of environmental interference (e.g., other electromagnetic signals). Sensor electrodes may be dedicated transmitters or receivers, or may be configured to both transmit and receive.

In one implementation, a trans-capacitance sensing method operates with two capacitive sensor electrodes underlying a touchsurface, one transmitter and one receiver. The resulting signal received by the receiver is affected by the transmitter signal and the location of the touchsurface.

In some embodiments, the sensor system used to detect touchsurface presses may also detect pre-presses. For example, a capacitive sensor system may also be able to detect a user lightly touching a touchsurface, and distinguish that from the press of the touchsurface. Such a system can support multi-stage touchsurface input, which can respond differently to light touch and press.

Some embodiments are configured to gauge the amount of force being applied on the touchsurface from the effect that the force has on the sensor signals. That is, the amount of depression of the touchsurface is correlated with one or more particular sensor readings, such that the amount of press force can be determined from the sensor reading(s).

In some embodiments, substrates used for sensing are also used to provide backlighting associated with the touchsurfaces. As a specific example, in some embodiments utilizing capacitive sensors underlying the touchsurface, the capacitive sensor electrodes are disposed on a transparent or translucent circuit substrate such as polyethylene terephthalate (PET), another polymer, or glass. Some of those embodiments use the circuit substrate as part of a light guide system for backlighting symbols viewable through the touchsurfaces.

FIG. 1 also shows a section line A-A' relative to the key 122 of the keyboard 100, which will be discussed below in connection with FIGS. 3A-B.

The keyboard 100 may be integrated into, or peripheral from and communicatively coupled to, a computer 101 comprising one or more processing systems formed from one or more ICs (integrated circuits) having appropriate processor-executable instructions for responding to key presses. These instructions direct the appropriate IC(s) to operate keyboard sensors to determine if a key has been pressed (or the extent of the press), and provide an indication of press status to a main CPU of the laptop or a response to the press status to a user of the laptop.

While the orientation terminology, vertical-lateral travel, sensing technology, and implementation options discussed here focuses on the keyboard 100, these discussions are readily analogized to other touchsurfaces and devices described herein.

Figure 2:
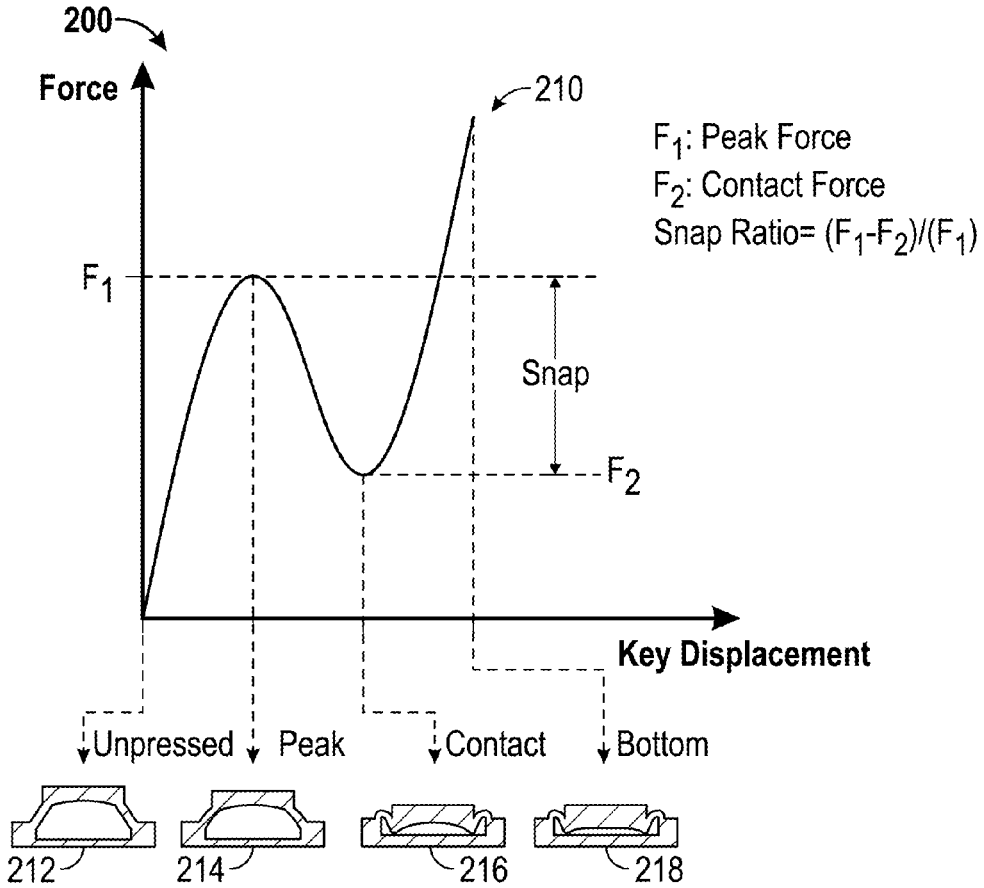
FIG. 2 is a graph of an example tactile response that is characteristic of many keys enabled with metal snap domes or rubber domes.

Various embodiments in accordance with the techniques described herein, including embodiments without metal snap domes or rubber domes, provide force response curves similar to the curve 210 of FIG. 2. Many tactile keyboard key embodiments utilize snap ratios no less than 0.4 and no more than 0.6. Other tactile keyboard key embodiments may use snap ratios outside of these ranges, such as no less than 0.3 and no more than 0.5, and no less than 0.5 and no more than 0.7.

Other embodiments provide other response curves having other shapes, including those with force and key travel relationships that are linear or nonlinear. Example nonlinear relationships include those which are piecewise linear, which contain linear and nonlinear sections, or which have constantly varying slopes. The force response curves may also be non-monotonic, monotonic, or strictly monotonic For example, the keys 120 made in accordance with the techniques described herein may be configured to provide the response shown by curve 210, or any appropriate response curve. The reaction force applied to a user may increase linearly or nonlinearly relative to an amount of total key travel, an amount of key travel the press direction, or an amount of key travel in a lateral direction. As a specific example, the force applied may increase with a constant slope relative to the amount of key travel for up to a first amount of force or key movement relative to its unpressed position, and then plateau (with constant force) or decrease for up to a second amount of force or key movement.

Figure 3A:
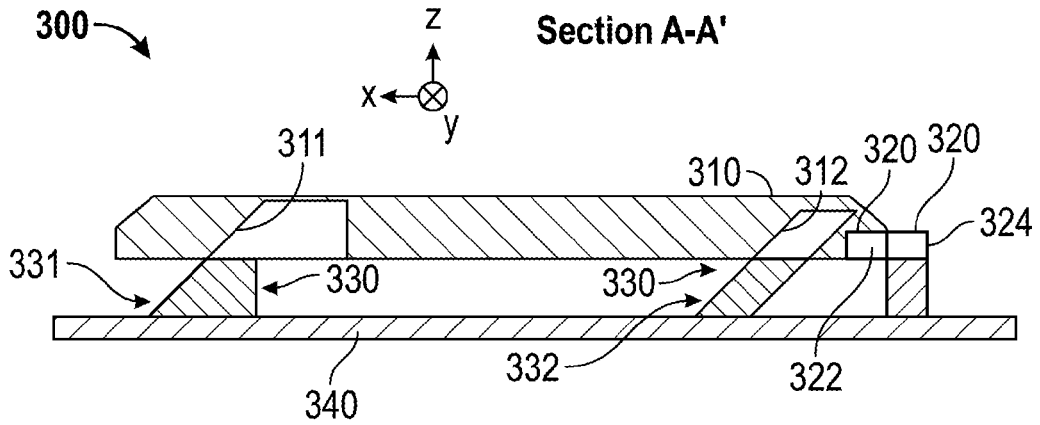
FIGS. 3A-3B are simplified side views of a first example touchsurface assembly configured in accordance with the techniques described herein.
Figure 3B:
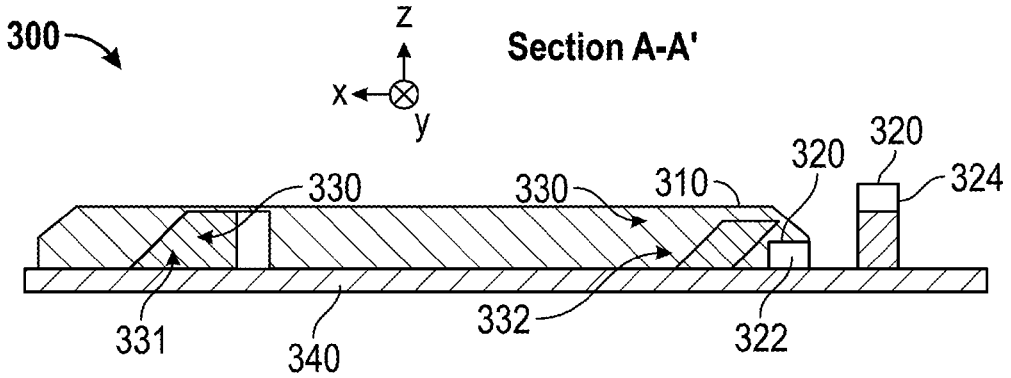

FIGS. 3A-3B are simplified cross-sectional views of a first example touchsurface assembly. The key assembly 300 may be used to implement various keys, including the key 122 of the keyboard 100. In the embodiment where FIGS. 3A-B depict the key 122, these figures illustrate A-A' sectional views of the key 122. FIG. 3A shows the example key assembly 300 in an unpressed position and FIG. 3B shows the same key assembly 300 in a pressed position. The key assembly 300 may also be used in other devices utilizing keys, including keyboards other than the keyboard 100 and any other appropriate key-using device. Further, assemblies analogous to the key assembly 300 may be used to enable non-key touchsurface assemblies such as buttons, opaque touchpads, touchscreens, or any of the touchsurface assemblies described herein.

The key assembly 300 includes a keycap 310 that is visible to users and configured to be pressed by users, a ready/return mechanism 320, and a base 340. The unpressed and pressed positions of the keycap 310 are spaced in a press direction and in a first lateral direction orthogonal to the press direction. The press direction is analogous to the key motion found in conventional keyboards lacking lateral key motion, is in the negative-Z direction, and is the primary direction of press and key motion. In many keyboards the press direction is orthogonal to the touchsurface of the keycap or the base of the key, such that users would consider the press direction to be downwards toward the base.

The components of the key assembly 300 may be made from any appropriate material, including plastics such as polycarbonate (PC), acrylonitrile butadiene styrene (ABS), nylon, and acetal, metals such as steel and aluminum, elastomers such as rubber, and various other materials. In various embodiments, the keycap 310 is configured to be substantially rigid, such that the touchsurface of the keycap 310 appears to unaided human senses to move with rigid body motion between its unpressed and pressed positions during normal operation.

The ready/return mechanism 320 is a type of "biasing mechanism" that provides both readying and returning functions. The ready/return mechanism 320 physically biases the keycap 310 during at least part of the key press operation. It should be noted that a mechanism which only provides readying or returning function may also be termed "biasing mechanism," if it biases the keycap 310 during at least part of the key press operation. The ready/return mechanism 320 is configured to hold the keycap 310 in its unpressed position so that the keycap 310 is ready to be pressed by a user. In addition, the ready/return mechanism 320 is also configured to return the keycap 310 partially or entirely to the unpressed position in response to a release of the press force to keycap 310. The release of the press force may be a removal of the press force, or a sufficient reduction of press force such that the key assembly is able to return the keycap 310 to the unpressed position as a matter of normal operation. In the example embodiment of FIG. 3, the key assembly 300 utilizes magnetically coupled components 322, 324 to form the ready/return mechanism 320. Magnetically coupled components 322, 324 may both comprise magnets, or one may comprise a magnet while the other comprise a non-magnetized but magnetically couple-able material such as non-magnetized ferrous material. Although magnetically coupled components 322, 324 are each shown as a single rectangular shape, either or both magnetically coupled components 322, 324 may comprise non-rectangular cross section(s) or comprise a plurality of magnetically coupled subcomponents having the same or different cross sections. For example, magnetically coupled component 322 or 324 may comprise a magnetized, box-shaped subcomponent disposed against a central portion of a ferrous, U-shaped subcomponent.

In some implementations, the magnetically coupled component 322 is physically attached to a bezel or base proximate to the keycap 310. The magnetically coupled component 324 is physically attached to the keycap and magnetically interacts with the magnetically coupled component 322. The physical attachment of the magnetically coupled components 322, 324 may be direct or indirect (indirect being through one or more intermediate components), and may be accomplished by press fits, adhesives, or any other technique or combination of techniques. The amount of press force needed on the keycap to overcome the magnetic coupling (e.g., overpower the magnetic attraction or repulsion) can be customized based upon the size, type, shape, and positions of the magnetically coupled components 322, 324 involved.

The key assembly 300 comprises a planar-translation-effecting (PTE) mechanism 330 configured to impart planar translation to the keycap 310 when it moves between the unpressed and pressed positions, such that a nonzero component of lateral motion occurs. The PTE mechanism 330 is formed from parts of the keycap 310 and the base 340, and comprises four ramps (two ramps 331, 332 are visible in FIGS. 3A-B) disposed on the base 340. These four ramps are located such that they are proximate to the corners of the keycap 310 when the key assembly 300 is assembled. In the embodiment shown in FIGS. 3A-B, these four ramps (including ramps 331, 332) are simple, sloped planar ramps located at an angle to the base 340. These four ramps (including ramps 331, 332) are configured to physically contact corresponding ramp contacting features (two ramp contacting features 311, 312 are visible in FIGS. 3A-B) disposed on the underside of the keycap 310. The ramp contacting features of the keycap 310 may be any appropriate shape, including ramps matched to those of the ramps on the base 340.

In response to a press force applied to the touchsurface of the keycap 310 downwards along the press direction, the ramps on the base 340 (including ramps 331, 332) provide reaction forces. These reaction forces are normal to the ramps and include lateral components that cause the keycap 310 to exhibit lateral motion. The ramps and some retention or alignment features that mate with other features in the bezel or other appropriate component (not shown) help retain and level the keycap 310. That is, they keep the keycap 310 from separating from the ramps and in substantially the same orientation when travelling from the unpressed to the pressed position.

As shown by FIGS. 3A-B, the keycap 310 moves in the press direction (negative Z-direction) in response to a sufficiently large press force applied to the top of the keycap 310. As a result, the keycap 310 moves in a lateral direction (in the positive X-direction) and in the press direction (in the negative Z-direction) due to the reaction forces associated with the ramps. The ramp contacting features (e.g., 311, 312) of the keycap 310 ride on the ramps of the base 340 (e.g., 331, 332) as the keycap 310 moves from the unpressed to the pressed position. This motion of the keycap 310 moves the magnetically coupled components 322, 324 relative to each other, and changes their magnetic interactions.

FIG. 3B shows the keycap 310 in the pressed position. For the key assembly 300, the keycap 310 has moved to the pressed position when it directly or indirectly contacts the base 340 or has moved far enough to be sensed as a key press. FIG. 3A-B do not illustrate the sensor(s) used to detect the press state of the keycap 310, and such sensor(s) may be based on any appropriate technology, as discussed above.

When the press force is released, the ready/return mechanism 320 returns the keycap 310 to its unpressed position. The attractive forces between the magnetically coupled components 322, 324 pull the keycap 310 back up the ramps (including the ramps 331, 322), toward the unpressed position.

Many embodiments using magnetic forces utilize permanent magnets. Example permanent magnets include, in order of strongest magnetic strength to the weakest: neodymium iron boron, samarium cobalt, alnico, and ceramic. Neodymium-based magnets are rare earth magnets, and are very strong magnets made from alloys of rare earth elements. Alternative implementations include other rare earth magnets, non-rare earth permanent magnets, and electromagnets.

Although the key assembly 300 utilizes magnetically coupled components to form its ready/return mechanism 320, various other techniques can be used instead or in addition to such magnetic techniques in other embodiments. In addition, separate mechanisms may be used to accomplish the readying and returning functions separately. For example, one or more mechanisms may retain the keycap in its ready position and one or more other mechanisms may return the keycap to its ready position. Examples of other readying, returning, or ready/return mechanisms include buckling elastomeric structures, snapping metallic domes, deflecting plastic or metal springs, stretching elastic bands, bending cantilever beams, and the like. In addition, in some embodiments, the ready/return mechanism push (instead of pull) the keycap 310 to resist keycap motion to the pressed position or to return it to the unpressed position. Such embodiments may use magnetic repulsion or any other appropriate technique imparting push forces.

Many variations of or additions to the components of the key assembly 300 are possible. For example, other embodiments may include fewer or more components. As a specific example, another key assembly may incorporate any number of additional aesthetic or functional components. Some embodiments include bezels that provide functions such as hiding some of the key assembly from view, protecting the other components of the key assembly, helping to retain or guide the touchsurface of the key assembly, or some other function.

As another example, other embodiments may comprise different keycaps, readying mechanisms, returning mechanisms, PTE mechanisms, leveling mechanisms, or bases. As a specific example, the keycap 310, the base 340, or another component that is not shown may comprise protrusions, depressions, or other features that help guide or retain the keycap 310. As another specific example, some embodiments use non-ramp techniques in place or (or in addition to) ramps to effect planar translation. Examples other PTE mechanisms include various linkage systems, cams, pegs and slots, bearing surfaces, and other motion alignment features.

As yet another example, although the PTE mechanism 330 is shown in FIGS. 3A-B as having ramps disposed on the base 340 and ramp contacting features disposed on the keycap 310, other embodiments may have one or more ramps disposed on the keycap 310 and ramp contacting features disposed on the base 340. Also, the PTE mechanism 330 is shown in FIGS. 3A-B as having ramps 331, 332 with simple, sloped plane ramp profiles. However, in various embodiments, the PTE mechanism 330 may utilize other profiles, including those with linear, piecewise linear, or nonlinear sections, those having simple or complex curves or surfaces, or those including various convex and concave features. Similarly, the ramp contacting features on the keycap 310 may be simple or complex, and may comprise linear, piecewise linear, or nonlinear sections. As some specific examples, the ramp contacting features may comprise simple ramps, parts of spheres, sections of cylinders, and the like. Further, the ramp contacting features on the keycap 310 may make point, line, or surface contact the ramps on the base 340 (including ramps 331, 332). "Ramp profile" is used herein to indicate the contour of the surfaces of any ramps used for the PTE mechanisms. In some embodiments, a single keyboard may employ a plurality of different ramp profiles in order to provide different tactile responses for different keys.

As a further example, embodiments which level their touchsurfaces may use various leveling techniques which use none, part, or all of the associate PTE mechanism.

Figure 4:
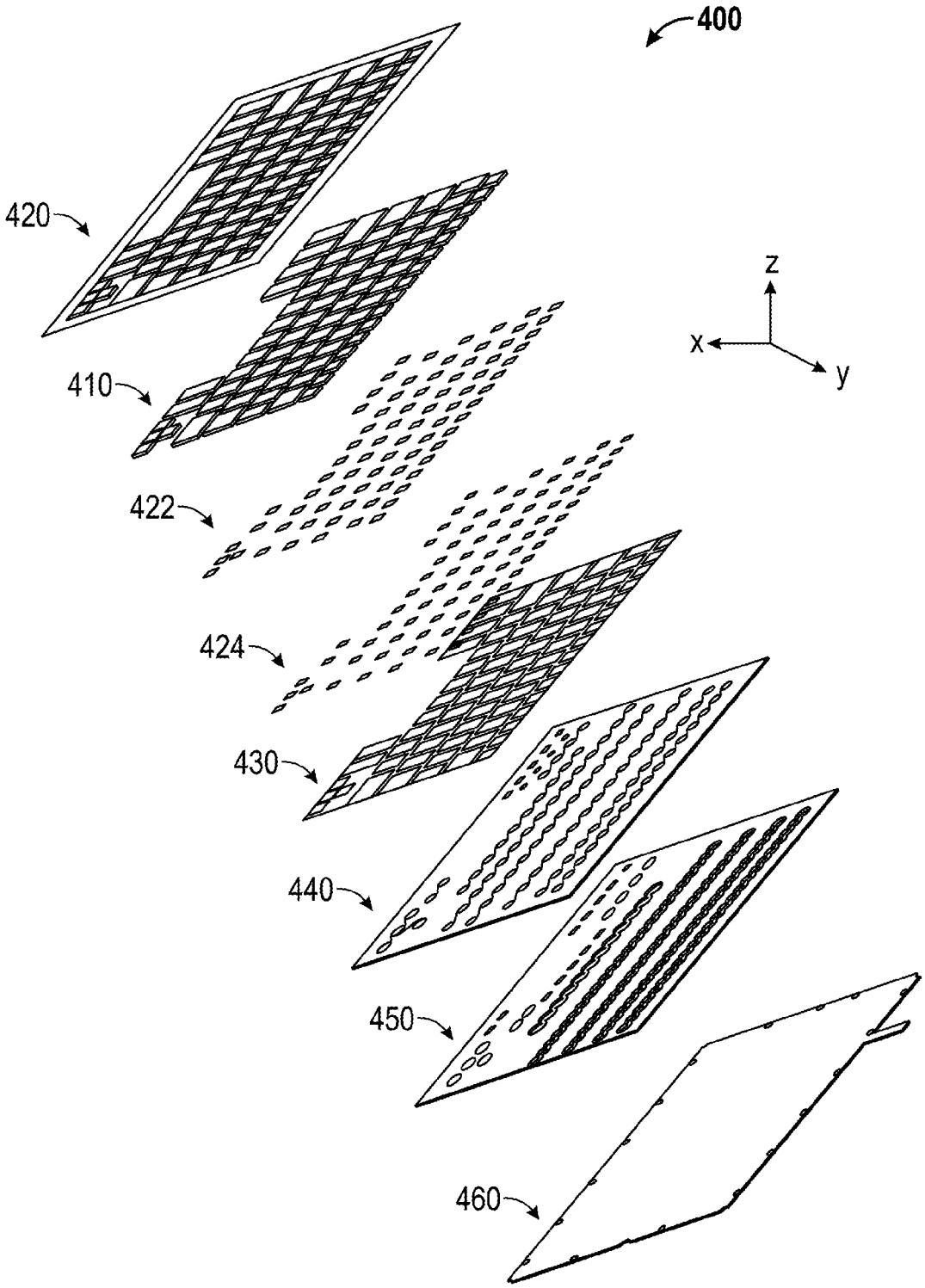
FIG. 4 shows an exploded view of an example keyboard in accordance with an embodiment.

FIG. 4 shows an exploded view of an example keyboard construction 400 in accordance with the techniques described herein. A construction like the keyboard construction 400 may be used to implement any number of different keyboards, including keyboard 100. Proceeding from the top to the bottom of the keyboard 400, the bezel layer 420 comprises a plurality of apertures through which keycaps 410 (or touch surfaces thereof) of various sizes are accessible in the final assembly. The bezel layer 420 may overlay part of the keycaps 410 to retain the keycaps 410 such as by or to providing a ready position stop. Magnetically coupled components 422 (comprising magnets, non-magnetized ferrous material, or both) are attached to (such as by being embedded in) the assembled keycaps 410. Underlying the keycaps 410 is a plurality of keyguides 430. The keyguides 430 may each be an individual part, and matched to the keycaps such that there is one keyguide 430 for each keycap 410. Alternatively, multiple keyguides 430 may be integrated together into a single part that guides multiple keycaps 410, or all of the keyguides 430 of the keyboard 400 may be integrated into a single component that guides all of the keycaps 410.

In some embodiments magnetically coupled components 424 (comprising magnets, non-magnetized ferrous material, or both) are attached to (such as by being embedded in) the keyguides 430 such that each keycap 410 is magnetically attracted to its associate keyguide 430. Some embodiments have one magnet per keycap-keyguide pair (so that only the keycap or keyguide has an attached magnet), and some embodiments have two magnets per keycap-keyguide pair (so that both the keycap and keyguide have attached magnets). Magnets used in some embodiments may be permanent magnets, such as rare earth magnets including neodymium iron boron magnets.

Underneath the keyguides 430 is a chassis 440 that provides structural support for the keyboard 400. The chassis may be formed by any appropriate technique from any appropriate material, including being comprised of a stamped sheet of metal, an injection molded plastic, or laser cut plastic. Underneath the chassis 440 is a circuit layer 450 which comprises one or more layers of circuitry disposed on one or more substrates. In some embodiments, the circuitry comprises sensor electrodes and routing traces for a sensor assembly configured for sensing when one or more keycaps 410 move from an unpressed position to a pressed position. In some embodiments, the chassis may include apertures to facilitate capacitive sensing of the keycaps 410 in their respective pressed positions, such as by sensing the magnets or ferrous-non magnetized material attached to the keycap 410.

In keyboard 400, underneath the circuit layer 450 is a backlighting layer 460 that is configured to provide light upwards toward one or more of the keycaps 410, so that a user viewing the keyboard 400 from the top can perceive light emitting from the keycaps 410, between the keycap 410 and the bezel 420, the bezel 420, or some combination thereof. The backlight layer 460 may comprise a light guide, an array of LEDs, an electroluminescent panel, some combination of the foregoing, or any other light emitting source permitting a user viewing the keyboard 400 from the top can perceive light emitting from the keycaps 410. Some alternate embodiments do not have a backlighting layer 460 underneath the circuit layer 450.

In some embodiments, the circuit layer 450 and the backlighting layer 460 are combined so that a same substrate is used for sensing and for backlighting. As a specific example, in some embodiments utilizing capacitive sensing, the capacitive sensor electrodes are disposed on a transparent or translucent substrate such as PET or glass, and this substrate is also used as a light guide for backlighting.

These different parts of the keyboard 400 may be formed from any appropriate material, including various plastics such as various plastics (e.g., polycarbonate, acetal, ABS, polyester), various metals (e.g., steel, iron, etc.), and various other materials (e.g., rubber). In addition, these different parts may be produced using any appropriate method, including injection molding, extrusion, stamping, casting, etc.

Various details have been simplified for ease of understanding. For example, adhesives that may be used to bond components together are not shown. Also, various embodiments may have more or fewer components than shown in keyboard construction 400, or the components may be in a different order. For example, the base and the key sensor 450 may be combined into one component, or swapped in the stack-up order.

Figure 5:
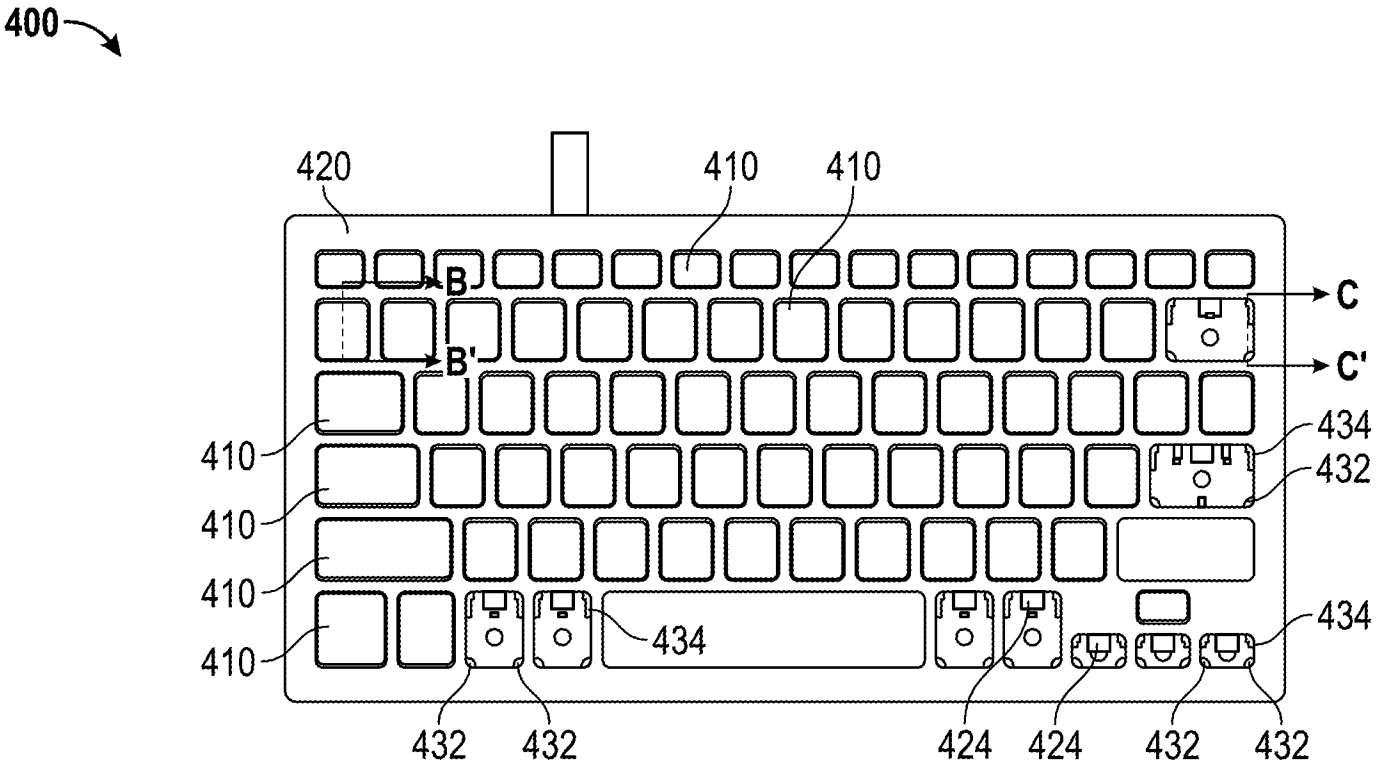
FIG. 5 shows an top view of an example keyboard in accordance with an embodiment.

FIG. 5 shows the keyboard 400 including the bezel 420 and keycaps 410 of various sizes. A few keys regions are shown without keycaps to illustrate some of the other layers. For example, top views of ramps 432 and 434 at the corners of the keyguide 430 are shown as well as the magnets (or non-magnetized ferrous material) 424 that are integrated into the keyguide 430.

Figure 6A:
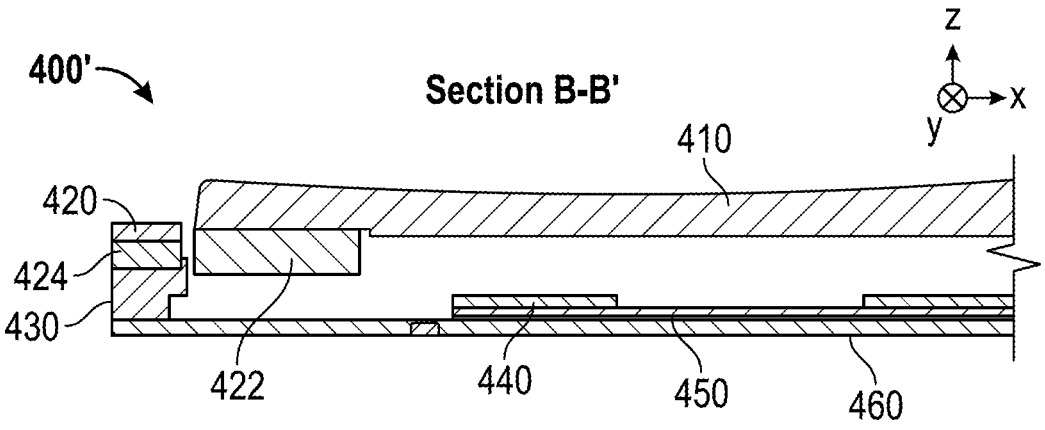
FIGS. 6A-B show simplified cross-sectional side views of an example key assembly according to an embodiment.
Figure 6B:
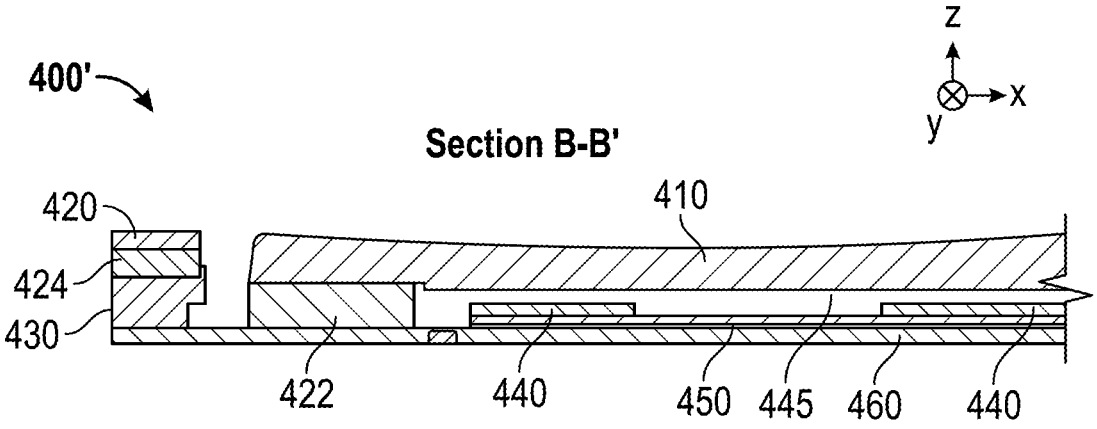

FIGS. 6A-B show simplified cross-sectional views of an example key assembly taken along section line B-B' of FIG. 5. FIG. 6A illustrates a cross-sectional view along a centerline of a key assembly 400' in an unpressed position. The ramps (432 and 434 in FIG. 5) are not visible in this view. FIG. 6A illustrates where the keycap 410 is held in a ready position (ready to be pressed) by the magnetic attraction of the magnetically coupled components (comprising magnet, non-magnetized ferrous material, or both) 422, 424. The magnetically coupled component 422 is associated with the keycap 410 while the magnetically coupled component 424 is associated with the keyguide 430. The chassis 440 can be seen to include an aperture 445 over the circuit layer 450. In the key assembly 400', this arrangement facilitates capacitive sensing through the chassis 440, which eliminates the need for the rubber domes disposed under the keycap conventionally employed in conventional resistive keyboards. Finally, the backlight layer 460 can be seen in FIGS. 6A-B; however, in some embodiments, the circuit layer 450 and the backlight layer 460 may be combined.

FIG. 6B illustrates that when a press force is applied to the keycap 410 and is sufficient to overcome the magnetic attraction between the magnetically coupled components 422 and 424, the keycap 410 is guided toward the pressed position by the keyguide 430. Specifically, as the keycap 410 moves along some combination of ramps (432 and 434 in FIG. 5) toward the pressed position, the keycap 410 travels in both a press direction (i.e., a negative Z direction) and also in a second direction orthogonal to the press direction (i.e., the positive or negative X, or the positive or negative Y, direction). In some embodiments the second direction would be toward the user pressing the touchsurface. This dual direction of movement gives the impression to the user that the keycap has traveled in the negative Z direction farther than it actually has. This allows a more compact (thinner) touchsurface assembly to impart to the user the feel of a conventional touchsurface assembly (e.g., a computer keyboard).

The magnetic attraction between the magnetically coupled components 422 and 424 provide a magnetic bias force that resists the press force and bias the keycap 410 toward the unpressed position. When the press force is reduced sufficiently below the magnetic attraction force, or removed completely, the magnetic attraction between the magnetically coupled components 422 and 424 moves the keycap 410 toward the unpressed position, returning the keycap 410 to the unpressed (ready) position as illustrated in FIG. 6A.

Figure 7A:
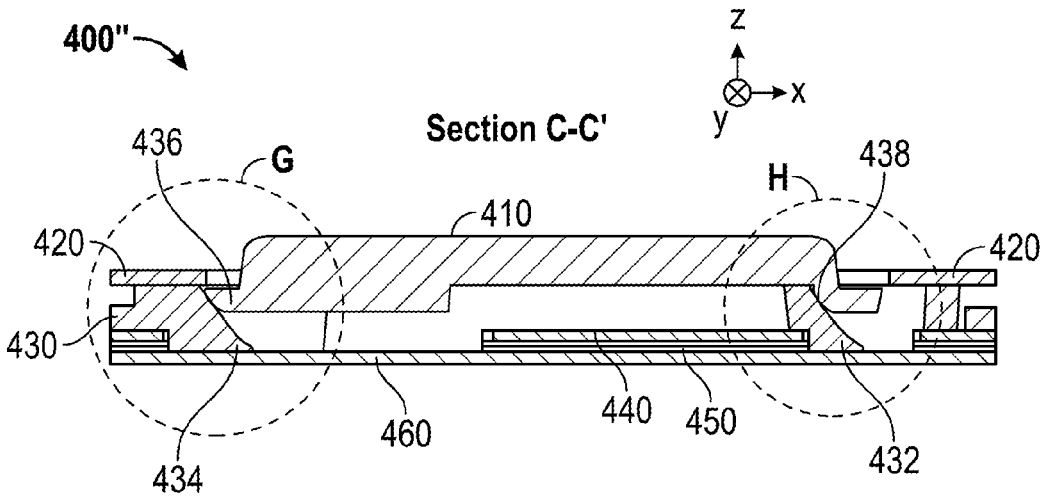
FIGS. 7A-C show simplified cross-sectional side views of an example key assembly illustrating the ramps and ramp contacting surfaces according to an embodiment.
Figure 7B:
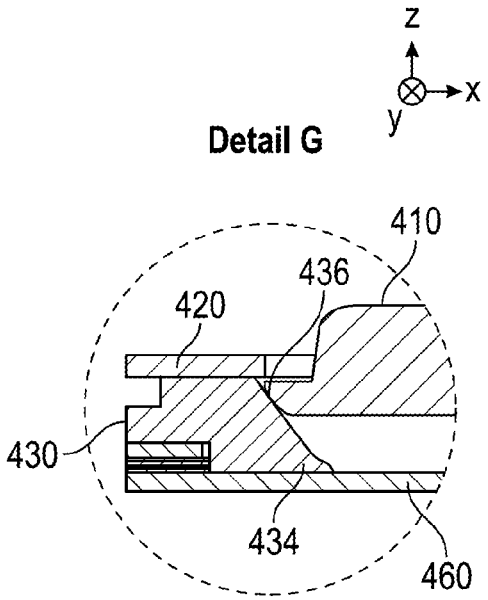
Figure 7C:
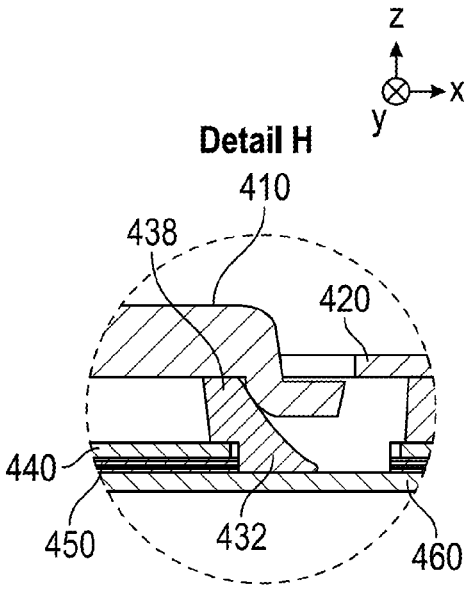

FIG. 7A illustrates a simplified cross-sectional view of an example key assembly taken along section line C-C' of FIG. 5, such that the ramps (432 and 434 in FIG. 5) are visible in this view. FIG. 7A illustrates a side view of a key assembly 400" in an unpressed position. The keyguide 430 includes ramp features 432 and 434 and the keycap 410 includes ramp contacting features 436 and 438. As shown in more detail in FIG. 7B, some combination of the ramp 434 will guide the ramp contacting feature 436 when the keycap moves toward the pressed position. In a similar manner illustrated in FIG. 7C, the ramp 432 will also guide the ramp contacting feature 438 when the keycap moves toward the pressed position.

When a press force is applied to the keycap 410, the ramp contacting features 436 and 438 moves down the ramps 432 and 434 toward the pressed position. Upon removal of the press force, a ready/return mechanism (discussed below) causes the ramp contacting features 436 and 438 moves along the ramps 432 and 433 toward the unpressed position.

Figure 8A:
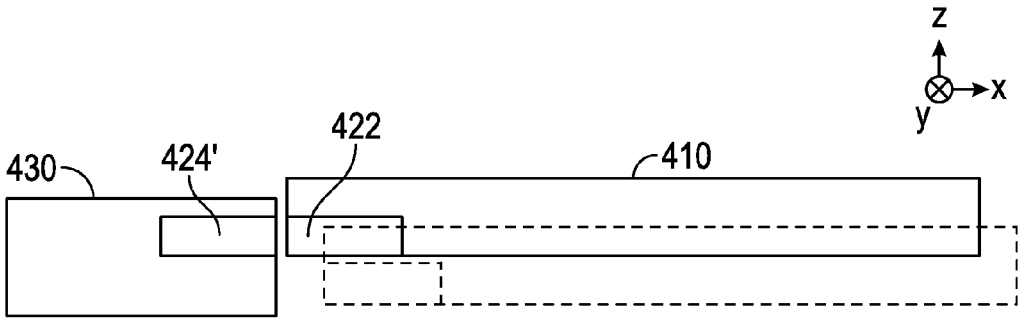
FIGS. 8A-C show simplified side views of ready/return mechanisms of an example key assembly according to an embodiment.
Figure 8B:
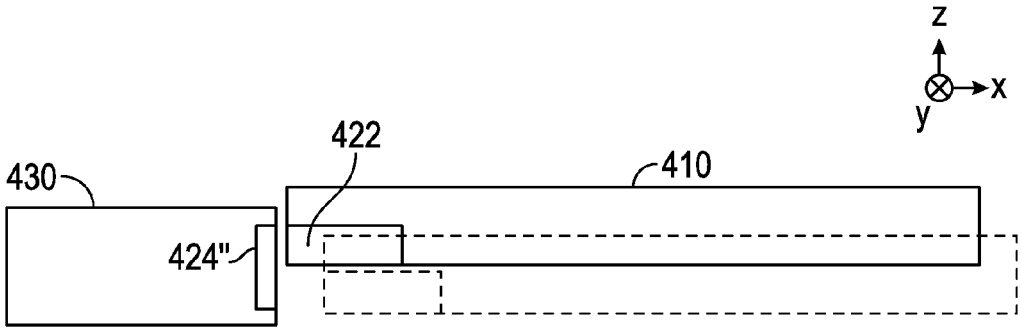
Figure 8C:
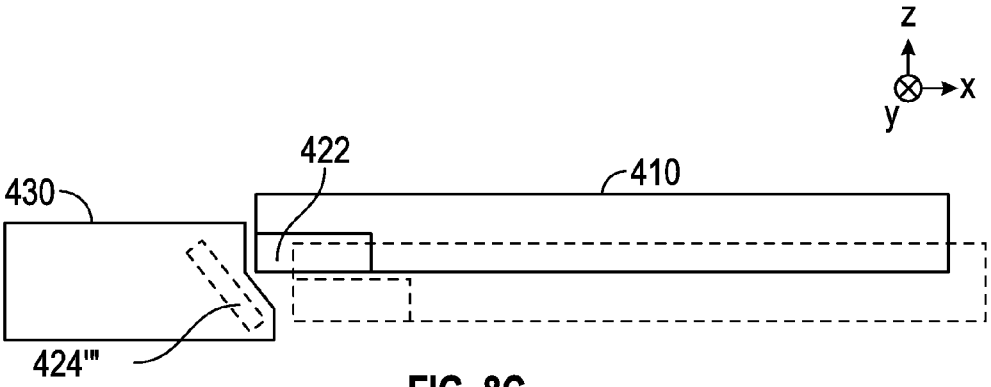

FIGS. 8A-C illustrate cross-sectional side views of an example key assembly with a ready/return mechanism comprising magnetically coupled components 422, 424. As mentioned earlier, the magnetically coupled components 422, 424 may each comprise a magnet, a piece of non-magnetized ferrous material, or a combination thereof. Further, some embodiments have one magnet per keycap-keyguide pair (where only the keycap 410 or keyguide 430 has an attached magnet), and some embodiments have two magnets per keycap-keyguide pair (where both the keycap and keyguide have embedded magnets). Magnets used may be permanent magnets, such as rare earth magnets including neodymium iron boron magnets.

In the examples shown in FIGS. 8A-C, when a press force is applied to the keycap 410 sufficient to overcome the magnetic attraction between the magnetically coupled components 422 and 424, the keycap 410 is guided toward the press position by the ramps (432 and 434 of FIGS. 7A-C) of the keyguide 430 toward the pressed position. As the keycap 410 moves between the unpressed and pressed positions, it travels in both a press direction (i.e., a negative Z direction in these examples) and also in a second direction orthogonal to the press direction (i.e., the positive X direction in these examples). In some embodiments, the second direction is toward the user pressing the touchsurface. When the press force is reduced below the magnetic bias force or removed, the magnetic attraction between the magnets 422 and 424 moves the keycap 410 toward the unpressed position.

In each of the examples shown in FIGS. 8A-C, the key assemblies may have multiple pairs of magnetically coupled components per keycap, where each magnetically coupled component comprises a magnet, non-magnetized ferrous material, or both.

FIG. 8A illustrates a first example where the two magnetically coupled components are similar in cross-sectional size and shape, and are oriented such that their longer sides are orthogonal to the press direction. The magnetically coupled component 424' is placed "horizontally" (i.e., with the longer dimension of its cross section shape along the X direction) in the keyguide 430. With this configuration in the unpressed position, a shorter side of the cross section shape of the magnetically coupled component 424' faces a shorter side of the cross section shape of the magnetically coupled component 422. The magnetically coupled component 424' does not extend vertically (i.e., in the Z direction) in the keyguide 430 to match the full vertical span of the magnetically coupled component 422 as the keycap 410 moves from the unpressed to the pressed position. In some embodiments, the magnetically coupled components 422, 424' each comprises one or more magnets, and the magnetically coupled components 422, 424' are positioned such that they present unlike magnetic poles to each other when the keycap 410 is in the unpressed position. In some embodiments, the magnetically coupled components 422 comprises a magnet while the magnetically coupled component 424' does not.

In FIG. 8B, the magnetically coupled component 424" is placed "vertically" (i.e., in the Z direction) in the keyguide 430, such that a longer side of the cross section shape of the magnetically coupled component 424" faces the magnetically coupled component 422 in the unpressed position. As will be appreciated, the configuration of FIG. 8B places more magnetic material (magnetized or not) in the magnetic flux path, especially where the keycap 410 is in the pressed position, as compared to the embodiment of FIG. 8A. Increased magnetic material in the flux path increases magnetic attraction, thus increasing the peak "F1" force of an associate force curve (see FIG. 2 for an example). In some embodiments, such "vertical" (Z axis) placement of the magnetically coupled components 422, 424" can be easier to install than "horizontally" (X axis) placed magnetically coupled components 422, 424".

Many alternatives to the examples shown in FIGS. 8A-B are possible. In other embodiments, the magnetically coupled components 422, 424 may have square, polygons with rounded corners, or other cross sections placed in similar or different orientations than those shown in FIGS. 8A-B. In some embodiments, the magnetically coupled components 422, 424 are oriented at an angle in the cross-sections shown in FIGS. 8A-B. For instance, in the embodiment shown in FIG. 8C, the magnetically coupled component 424'" is angled relative to the press direction. In this embodiment, the magnetically coupled components 422, 424 are closer to each other in the pressed position when compared to the embodiments of 8A-B.

Figure 9A:
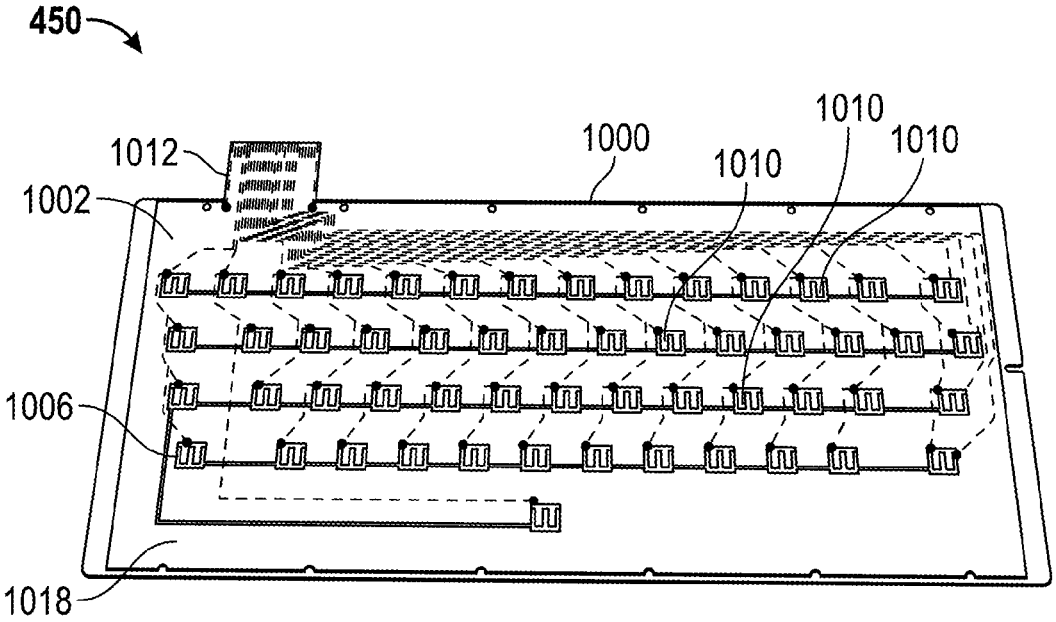
FIGS. 9 A-B illustrate an exemplary construction for a sensor layer according to an embodiment.
Figure 9B:
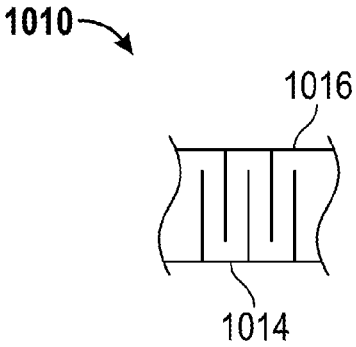

FIGS. 9A-B illustrates an exemplary circuit layer 450 (see FIG. 4) construction in accordance with various embodiments. The exemplary circuit layer 450 construction of FIGS. 9A-B comprises a substrate 1000 with a top surface 1002 having conductive material 1006 disposed thereon, and conductive material 1008 a bottom surface (and thus shown in dotted form) of the circuit layer 450. The conductive material 1006 forms sensor electrodes 1010 comprising linked sets of E shaped sensor electrodes and a matrix of E shaped sensor electrodes electrically coupled to each other in columns by conductive material 1008 disposed on the bottom surface. The conductive material 1006 also route the sensor electrodes 1010 (via conductive material 1008) to an interconnect 1012 for electrical coupling to a processing system (e.g., 101 of FIG. 1). In an exemplary circuit layer 450 construction of this embodiment, the substrate 1000 comprises polyester material such as PET, and is configured to be flexible. The conductive patterns 1006 and 1008 comprise conductive ink (such as silver or carbon ink) printed on the substrate.

As shown in FIG. 9A, the conductive material 1006 on the top surface 1002 of the substrate 1000 comprises a pattern with conductive sections of material arranged in four rows extending along the width of the key area of the circuit layer 450. In this example, the space bar is detected as part of the third row from the top of the figure. In some alternate embodiments, the space bar is treated separately, and a separate routing line couple to the sensor electrode in front of the four rows that detects the space bar.

Specifically, as shown in FIG. 9A, this exemplary circuit 450 construction comprises a plurality of sensor electrodes 1010 each comprising a plurality of conductive pads 1014 and 1016 (also "conductive elements"). Subsets of the conductive pads 1014 are ohmically coupled to each other, as are subsets of the conductive pads 1016. These conductive pads 1014, 1016 are configured in the shape of square-waves, although other shapes (such as sinusoids, triangles, pseudo-random shapes, etc.) are possible. With the square-wave configuration shown, the conductive pads 1014, 1016 comprise two or three tines each and resemble sets of Π and E shapes. Conductive pads 1014 with three tines (E's) are interleaved with conductive pads with two tines 1016 (Π's), and together they outline a region roughly square in shape. The sensor electrodes 1010 are a part of a sensor system able to detect the pressed states of keycaps 410 disposed above sensor electrodes 1010. In some embodiments, the sensor system detects the unpressed and/or pressed positions of the keycaps 410 over the sensor electrodes 1010. In some embodiments, the sensor system detects a motion of the keycap 410.

Surrounding the sensor electrodes 1010 and their associated routing lines is a mesh of conductive material 1018 that may be left electrically floating, used as an electric shield by being held at a constant voltage (such as ground), or driven through a varying voltage waveform.

FIG. 9A also shows the interconnecting lines on the bottom surface (in dotted form) of the substrate that electrically connect select ones of the conductive pads 1014 to form transmitter electrodes extending the width of the substrate. Conductive pads 1016 are connected through vias to routing lines 1008 on the bottom surface, which connect sets of the conductive pads into sixteen (in the illustrated embodiment) columnar receiver electrodes.

In the assembled device, the sensor electrodes 1010 (and the shield if used) are communicatively coupled via the interconnect 1012 to a processing system (e.g., 101 in FIG. 1). The processing system is configured to transmit with the transmitter electrodes 1014 and to receive resulting signals with the receiver electrodes 1016 during operation. The processing system (e.g., 101 in FIG. 1) may be configured to use any appropriate sensing scheme. Example sensing schemes comprise drive signals having different voltage waveforms, including square waves, triangular waves, sinusoidal waves, and the like. Similarly, example sensing schemes comprise driving or receiving on single sensor electrodes at a time, driving or receiving on multiple sensor electrodes simultaneously, or a combination thereof. As a specific example, the processing system may be configured to drive each of the transmitters at different times, and to receive on all of the receivers simultaneously each time a different transmitter is driven. The transmitter sequence may be realized as a drive pattern that proceeds from the transmitter electrode closest to the back (or front) of the assembled keyboard to the front (or back) of the assembled keyboard. Similarly, the transmitter sequence may be realized as a driver pattern that proceeds from a left of the assembled keyboard to the right, or vice versa.

In various embodiments, the associated keycaps 410 of the keyboard 400 comprise components configured for mechanical response as well as electrical response. For example, the keycaps may comprise materials of high dielectric constant, such that the motion of the dielectric material of the keycap into the electric field between the transmitter electrodes 1014 and receiver electrodes 1016 alters the capacitive coupling in a detectable way. As another example, magnets or non-magnetized ferrous material embedded in the keycaps to provide ready/return function may also be used to alter the capacitive coupling between sensor electrodes 1010 in a detectable way. In various embodiments, the keycaps comprise additional components configured specifically for electrical response. For example, dielectric or conductive key hassocks may be coupled to the keycaps 410. As another example, dielectric or conductive material may be embedded into the keycap. In some embodiments, the keycaps themselves are formed from material configured for electrical response. For example, the keycaps may be formed from conductive material. In the embodiments with conductive material in the keycap, this conductive material may be left electrically floating, held at a constant voltage such as ground, or driven with a voltage waveform in operation.

In various embodiments, some combination of the components configured for mechanical response, components configured for electrical response, or the key material are used to provide the change in capacitive coupling that is detected.

In one embodiment discussed above, a magnet 422 embedded in the keycap 410 provides the ready/return function also alters the electric field between the transmitter electrodes 1014 and the receiver electrodes 1016 in response to a press of the keycap. This magnet 422 may be augmented by a piece of conductive foam (not shown) that is about half the size of the magnet and disposed right next to the magnet. The magnet and conductive foam are electrically floating during operation.

In some embodiments, a protective covering is positioned above the top surface 1002, including above the sensor electrodes 1010, to protect the sensor electrodes 1010 from the environment and physical damage, for aesthetics (e.g., to reduce the visibility of the electrodes and the top surface 1002), or both. The protective covering may comprise a liquid or gel material that hardens when cured (such as paint and solder mask), a solid material such as various plastic films, or combinations thereof (if multiple protective coverings are used). Where backlighting of the keycaps is accomplished by light emitting from the circuit layer 450 or a backlighting layer 460, the covering can be configured to be conducive to the desired backlighting.

Figure 10:
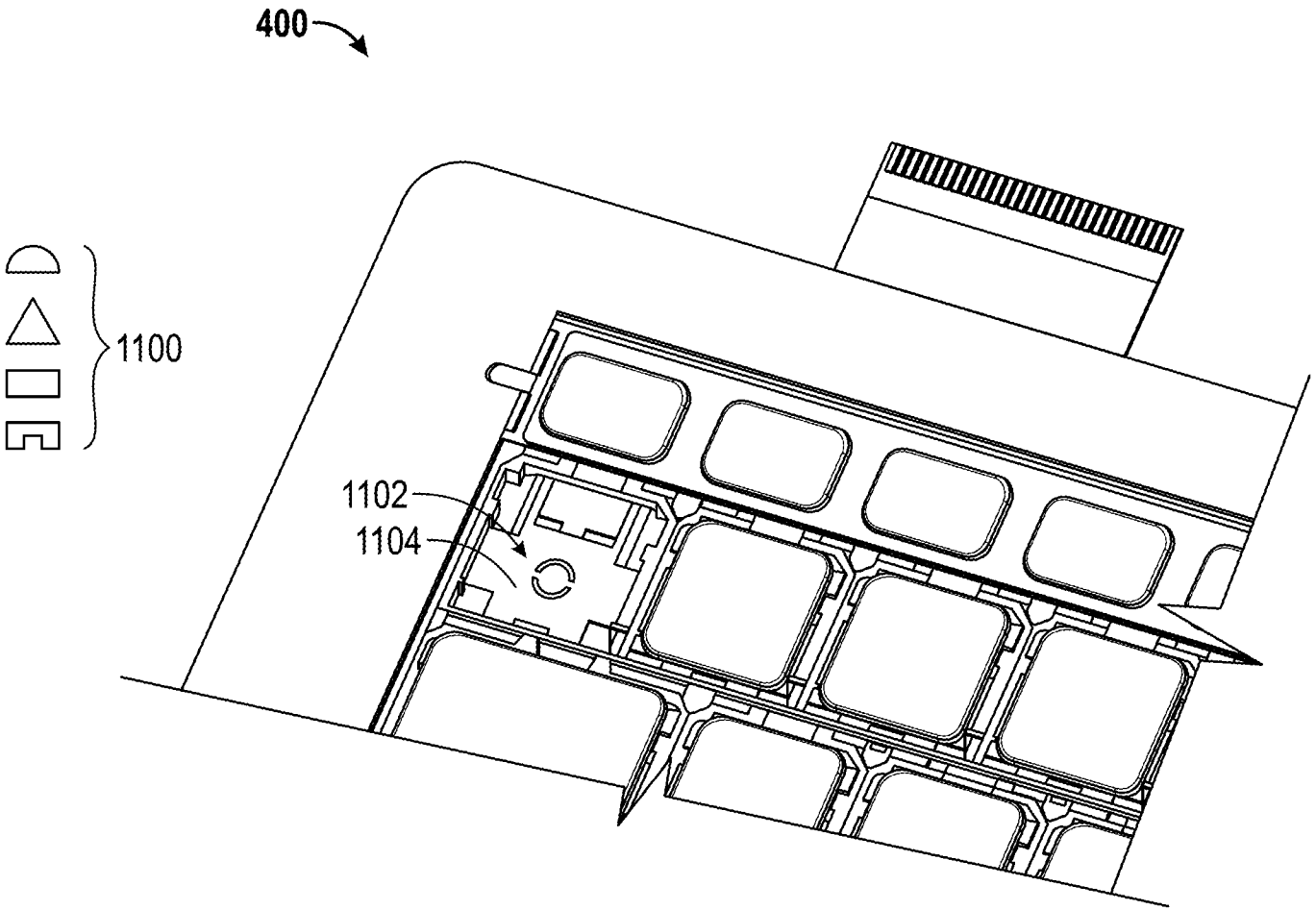
FIG. 10 illustrates exemplary end-stops and placement options for a key assembly according to an embodiment.

As illustrated in FIG. 10, some keyboard embodiments are configured with end-stops 1100 placed on a top of the chassis 440 or the circuit layer 450. In some embodiments, end-stops 1100 are attached to a bottom of the keycap 410. The end-stop may be a hemisphere, cone, square, rectangle, cup, a section of a sphere, or some other shape.

Where the end-stops 1100 are attached to the chassis 440, the end-stops 1100 may comprise protrusions of a layer of material, such that one component provides end stop function for a plurality of keycap 410*s*. Where attached to the keycaps, the end-stops 1100 are generally configured to be one end-stop for each key.

FIG. 10 shows the keyboard 400 with a keycap removed. Visible is a "cap spacer" layer 1102 disposed between the circuit layer and the chassis. The cap spacer layer 1102 has two semicircular arcs 1104 inscribed on it in FIG. 10, to indicate the location of any exemplary end-stop may be adhered to the center to center the end-stop beneath the keycap.

Some embodiments utilize end-stops 1100 of the same design and material for all of the keycaps, such that similar press responses are provided by these end-stops. Some embodiments utilize end-stops of the different designs (e.g., size, shape) or material for at least some keycaps, such that different keycaps have different end-stop provided press responses.

Some example materials that may be used as end stops 1100 include various plastics, rubbers, gels, liquids, gases, or combinations thereof (such as various foams). For example, rubber end-stops may be manufactured by adhering or otherwise attaching a thermoplastic elastomer, thermoplastic rubber, or liquid silicone rubber material to the bottom of a keycap, the top of a chassis, another component located between the bottom of the keycap and the chassis. Select materials may also be directly molded onto the keycap, the chassis or an intermediately located component.

In some embodiments, the end-stops 1100 are configured to provide a repeatable compliance for the associated keycap, such that the end-stop deformation is repeatable in response to repeated applications of the same press force. In some embodiments, the end-stops 1100 are further configured to correlate the amount press force with amount of deformation in a linear or nonlinear way, such that the press force applied after the keycap has contacted the end-stop is correlated to the distance the keycap is from sensor electrodes 1010 on the circuit layer 450. A larger press force brings the keycap in closer proximity. In this way, the sensor electrodes 1010 can be configured to determine the amount of press force applied when the keycap has reached the end-stop.

Thus, the techniques described herein can be used to implement a variety of keyboards having a sensor layer below the chassis layer as described herein. For example, some embodiments of keyboards each comprises a chassis, a plurality of key assemblies, and a key sensor below the chassis. The key sensor is configured to detect pressed states of one or more keycaps of the plurality of key assemblies. At least one key assembly of the plurality of key assemblies comprises a keycap, a keyguide and an magnetic ready/return mechanism. In some embodiments, the keycap is configured to move between an unpressed position and a pressed position relative to the chassis, where the unpressed and pressed positions are separated vertically (in a press direction) and laterally (in a second direction orthogonal to the press direction).

The implementations described herein are meant as examples, and many variations are possible. As one example, any appropriate feature described with one implementation may be incorporated with another. As a first specific example, any of the implementations described herein may or may not utilize a finishing tactile, aesthetic, or protective layer.

In addition, the structure providing any function may comprise any number of appropriate components. For example, a same component may provide leveling, planar translation effecting, readying, and returning functions for a key press. As another example, different components may be provide these functions, such that a first component levels, a second component effects planar translation, a third component readies, and a fourth component returns. As yet another example, two or more components may provide a same function. For example, in some embodiments, magnets and springs together provide the return function, or the ready and return functions.

What is claimed is:

1. A keyboard, comprising:

a keyboard chassis;

a plurality of keycaps positioned above the keyboard chassis, each keycap of the plurality of keycaps having a touch surface for receiving a press force;

a sensor substrate positioned below the keyboard chassis and having sensor electrodes configured to sense that one or more keycaps of the plurality of keycaps is in a pressed position; and a processing system coupled to the sensor electrodes and configured to operate the sensor electrodes to capacitively detect the one or more keycaps of the plurality of keycaps in the pressed position, wherein the sensor electrodes comprise at least one transmitter electrode and at least one receiver electrode, wherein the processing system operates the at least one transmitter electrode to transmit a transmitter signal and operates the at least one receiver electrode to receive a resulting signal, and wherein the processing system determines that the one or more keycaps is in the pressed position via a parameter of the resulting signal.

2. The keyboard of claim 1, further comprising:

a bezel having apertures permitting access to the plurality of keycaps; and a plurality of biasing mechanisms positioned between the plurality of keycaps and the keyboard chassis, each of the plurality of biasing mechanisms biasing a respective keycap of the plurality of keycaps toward an unpressed position.

3. The keyboard of claim 2, wherein each of the plurality of biasing mechanisms comprises a magnetic biasing mechanism.

4. The keyboard of claim 3, wherein the magnetic biasing mechanism of at least one of the plurality of biasing mechanisms comprises a magnet and a non-magnetized ferrous material.

5. The keyboard of claim 3, wherein each of the plurality of keycaps has a respective magnetic biasing mechanism and each of the plurality of keycaps includes a first portion of the respective magnetic biasing mechanism, and the keyboard further comprises:

a plurality of key guides respectively associated with the plurality of keycaps, each of the plurality of key guides including a second portion of the respective magnetic biasing mechanism.

6. The keyboard of claim 1, further comprising a backlight layer positioned below the keyboard chassis.

7. The keyboard of claim 1, further comprising a backlight layer positioned below the sensor substrate.

8. The keyboard of claim 1, wherein the keyboard chassis has a plurality of apertures positioned between the one or more keycaps of the plurality of keycaps and the sensor electrodes to facilitate sensing the one or more keycaps of the plurality of keycaps moving toward the pressed position.

9. The keyboard of claim 1, further comprising a plurality of end stops respectively positioned between the keyboard chassis and the plurality of keycaps.

10. A key assembly, comprising:

a chassis;

a keycap positioned above the chassis and having a touch surface for receiving a press force;

a biasing mechanism positioned between the keycap and the chassis, the biasing mechanism biasing the keycap toward an unpressed position;

a sensor substrate positioned below the chassis and having sensor electrodes configured to sense that the keycap is in a pressed position; and a processing system coupled to the sensor electrodes and configured to operate the sensor electrodes to capacitively detect the keycap in the pressed position, wherein the sensor electrodes comprise at least one transmitter electrode and at least one receiver electrode, wherein the processing system operates the at least one transmitter electrode to transmit a transmitter signal and operates the at least one receiver electrode to receive a resulting signal, and wherein the processing system determines that the keycap is in the pressed position via a parameter of the resulting signal.

11. The key assembly of claim 10, wherein the biasing mechanism comprises a magnetic biasing mechanism.

12. The key assembly of claim 10, wherein the keycap includes a first portion of the magnetic biasing mechanism and the key assembly further comprises: a key guide including a second portion of the magnetic biasing mechanism.

13. The key assembly of claim 10, further comprising a backlight layer positioned below the chassis.

14. The key assembly of claim 10, further comprising a backlight layer positioned below the sensor substrate.

15. The key assembly of claim 10, further comprising an end stop positioned between the chassis and the keycap to provide a resilient keycap stop when the keycap is in the pressed position.

16. The key assembly of claim 10, further comprising a processing system coupled to the sensor electrodes and configured to operate the sensor electrodes to capacitively detect that the keycap is in the pressed position.

17. A keyboard, comprising:

a keyboard chassis;

a plurality of keycaps positioned above the keyboard chassis, each keycap of the plurality of keycaps having a touch surface for receiving a press force;

a plurality of key guides each respectively associated with a keycap of the plurality of keycaps;

a plurality of end stops associated with the plurality of keycaps, each end stop positioned between the keyboard chassis and a respective keycap;

a plurality of biasing mechanisms each associated with a respective keycap of the plurality of keycaps and a respective key guide of the plurality of key guides, wherein each biasing mechanism comprises a first portion attached to the respective keycap and a second portion attached to the respective key guide, and wherein each respective biasing mechanism biases the respective keycap toward an unpressed position;

a sensor substrate positioned below the keyboard chassis and having sensor electrodes configured to sense that one or more of the plurality of keycaps is in a pressed position; and a processing system coupled to the sensor electrodes and configured to operate the sensor electrodes to capacitively detect one or more keycaps of the plurality of keycaps in the pressed position, wherein the sensor electrodes comprise at least one transmitter electrode and at least one receiver electrode, wherein the processing system operates the at least one transmitter electrode to transmit a transmitter signal and operates the at least one receiver electrode to receive a resulting signal, and wherein the processing system determines that the one or more keycaps is in the pressed position via a parameter of the resulting signal.

18. The keyboard of claim 17, further comprising a backlight layer positioned below the keyboard chassis.

19. The key assembly of claim 10, wherein the pressed position is both vertically and laterally displaced from the unpressed position.

20. The keyboard of claim 17, wherein the pressed position is both vertically and laterally displaced from the unpressed position.

* * * * *